US006793437B2

(12) United States Patent
Kitko et al.

(10) Patent No.: US 6,793,437 B2
(45) Date of Patent: Sep. 21, 2004

(54) SIDE-MOUNTED SHOULDER COMPACTION ROLLER

(75) Inventors: Joseph P. Kitko, Madera, PA (US); Michael C. Wolf, Osceola Mills, PA (US)

(73) Assignee: Glenn O. Hawbaker, Inc., State College, PA (US)

( * ) Notice: Subject to any disclaimer, the term of this patent is extended or adjusted under 35 U.S.C. 154(b) by 0 days.

(21) Appl. No.: 10/235,526

(22) Filed: Sep. 5, 2002

(65) Prior Publication Data

US 2004/0047686 A1 Mar. 11, 2004

(51) Int. Cl.[7] ..... E01C 19/23
(52) U.S. Cl. ..... 404/126; 404/128; 404/127
(58) Field of Search ..... 404/122, 123, 404/124, 125, 126, 127, 128, 131, 132

(56) References Cited

U.S. PATENT DOCUMENTS

| | | | | | |
|---|---|---|---|---|---|
| 16,195 | A | * | 12/1856 | Thompson | 404/132 |
| 85,641 | A | * | 1/1869 | Capron | 404/126 |
| 151,332 | A | * | 5/1874 | Woolridge | 404/126 |
| 153,452 | A | * | 7/1874 | Miller | 404/126 |
| 181,734 | A | * | 8/1876 | Smith | 404/125 |
| 187,121 | A | * | 2/1877 | Gates | 404/122 |
| 194,603 | A | * | 8/1877 | Kidder | 404/126 |
| 201,368 | A | * | 3/1878 | Ufford | 404/125 |
| 247,698 | A | * | 9/1881 | Sherwin | 404/126 |
| 256,028 | A | * | 4/1882 | Moore | 404/125 |
| 352,710 | A | * | 11/1886 | Parsons | 404/122 |
| 368,926 | A | * | 8/1887 | Bates | 404/126 |
| 377,066 | A | * | 1/1888 | Foose | 404/125 |
| 634,737 | A | * | 10/1899 | Newman | 404/126 |
| 649,423 | A | * | 5/1900 | Hinman | 404/122 |
| 681,297 | A | * | 8/1901 | Bruckman | 404/126 |
| 694,213 | A | * | 2/1902 | Stark | 404/125 |
| 976,293 | A | * | 11/1910 | Reiff | 404/122 |
| 1,293,600 | A | * | 2/1919 | Winegarner | 404/125 |
| 1,304,741 | A | * | 5/1919 | Cartright | 404/126 |
| 1,559,406 | A | * | 10/1925 | Carson | 404/127 |
| 2,230,317 | A | * | 2/1941 | Zettelmeyer | 404/125 |
| 2,691,927 | A | * | 10/1954 | Denton | 172/115 |
| 3,072,025 | A | * | 1/1963 | Cronin | 404/127 |
| 3,302,540 | A | | 2/1967 | Fuentes, Jr. | |
| 3,403,610 | A | | 10/1968 | Kaltenegger | |
| 3,947,142 | A | | 3/1976 | Takata et al. | |
| 4,040,761 | A | * | 8/1977 | Rahn | 180/198 |
| 4,043,738 | A | * | 8/1977 | Modesto et al. | 425/456 |
| 4,167,360 | A | | 9/1979 | Dick, Jr. | |
| 4,260,281 | A | * | 4/1981 | Sargent | 404/127 |
| 4,471,850 | A | | 9/1984 | Rotz | |
| 4,662,779 | A | | 5/1987 | Kaltenegger | |
| 4,699,543 | A | | 10/1987 | Mio et al. | |
| 4,861,189 | A | | 8/1989 | Fukukawa et al. | |
| 4,878,544 | A | | 11/1989 | Barnhart | |
| 4,964,753 | A | | 10/1990 | Ciminelli et al. | |
| 5,046,891 | A | | 9/1991 | Vural | |
| 5,082,396 | A | | 1/1992 | Polacek | |

FOREIGN PATENT DOCUMENTS

| | | | | | |
|---|---|---|---|---|---|
| CH | 662381 | A | * | 9/1987 | E01C/19/26 |
| DE | 3318191 | A1 | * | 11/1984 | E01C/19/26 |

* cited by examiner

*Primary Examiner*—Robert E. Pezzuto
*Assistant Examiner*—Alexandra K. Pechhold
(74) *Attorney, Agent, or Firm*—McQuaide, Blasko, Schwartz, Fleming & Faulkner, Inc.

(57) ABSTRACT

A compaction roller particularly useful for vibration compaction of the shoulder area of roadways. The compactor is designed as an attachment for side-mounting to self-propelled or motorized machinery (e.g. a skid steer front loader). The compaction roller contains: (a) a front section comprising a frame connected to a front cylindrical roller; (b) a rear section comprising a frame connected to a rear cylindrical roller; (c) a joining means pivotally connecting said front and rear sections; and (d) a means for attaching to a self-propelled machinery in a side-mounted fashion. The pivoting compactor allows for simultaneous pinching and compacting on two different planes and reduces the hazards of operating a road roller compactor directly on a sloped surface.

9 Claims, 4 Drawing Sheets

SIDE-MOUNTED SHOULDER COMPACTION ROLLER

FIELD OF THE INVENTION

The invention relates to roller compactors for compacting roadways or other earthen structures. In particular the invention relates to a side-mounted vibratory roller for rolling sloped shoulder areas.

BACKGROUND OF THE INVENTION

The construction of roadways and related features typically requires the use of machinery to compact or densify the roadway material. The roadway material can be any base that needs to be compacted to finished state, e.g. asphalt, aggregate, stone, earth, gravel, and the like. A variety of machines in recent decades have been created to satisfy these compacting needs and many machines have become specialized for specific compacting applications. One general class of machinery for compacting is known as "road rollers". Road rollers contain one or more cylindrical drums that roll over the material being compacted. Typically these road rollers comprise (in a broad sense) a frame, front and rear drums, an engine, and a driving/steering mechanism for a driver. The rolling action is often enhanced by a vibration action. The vibration action can be caused by a vibration unit inside the drum or external to it. The most common approach for producing vibration in a road roller is the use of unbalanced weights that are mounted on a rotating shaft inside the drum.

One particular use of such vibratory road rollers has been to roll the "shoulder" area of roadways and other surfaces such as parking lots and recreation areas. The shoulder area is a strip (usually a few feet or less) of material just off the edge of the main surface that is often filled and compacted for safety and structural (e.g. drainage) reasons. In the case of a roadway shoulder, when a vehicle veers off of the road, the shoulder area provides a smooth and safer transition off of the roadway.

Shoulders are made by filling the area with aggregate or asphalt at a sloped angle and then compacting with a vibratory roller of some type. The shoulder area is compacted to avoid having a loose, unsafe gravel area on the shoulder and to make the shoulder area maintain its stability longer. Additionally, at the time of compacting the shoulder, the seam where the main surface area and shoulder meet is also "pinched". Pinching involves compacting the seam where the main surface and the shoulder meet to help ensure a smooth transition from the main surface to the shoulder. In practice, the operator of a road roller will perform the pinching and the shoulder compacting in two separate rolls. For example, the operator will drive forward to pinch the seam and then will drive in reverse to compact the shoulder wedge only. Additionally, a third pass may be performed as the operator drives forward over the pinched or shoulder wedge again. This leads to an inefficiency in the process as two or more passes are performed. This procedure also creates an additional hazard because part of the operation is done with the operator traveling in reverse which is more difficult than traveling forward.

Roadways are often elevated somewhat from the surrounding environment for safety and drainage reasons. This design creates shoulder areas that are sloped down from the roadway. It is common for this slope to be up to 10 degrees or more. In fact, there is an incentive to make this slope steeper because less material (e.g. aggregate) is generally required to make a steeper shoulder thus leading to cost savings. This creates a hazard for the construction crew in compacting such sloped shoulders. In a shoulder rolling operation, typically the operator of the road roller will travel forwards and backwards generally parallel to the roadway on the seam and shoulder area. During this compaction the road roller is being operated in a tilted manner at the same angle as the slope in the shoulder. It has been recognized that in some circumstances operating a roller in such a tilted manner may increase the chance of the roller tipping and potentially causing harm to the operator. It would be safer if the operator of shoulder compacting machinery were not on the compactor itself. While compactors are available in which the operator does not ride on the roller itself, but rather pushes or guides it, they are not very practical for shoulder rolling (especially larger projects) because of the slower speeds and difficulty of controlling them on sloped surfaces. Additionally, the walk behind type compacters tend to roll or slide down out of control down the grade which can cause operator injury and/or equipment damage. Because of these disadvantages, all or nearly all roadway shoulder compacting operations (to the inventors' knowledge) are performed with a road roller having an operator seated on the roller itself.

A large variety of solutions have been created for rolling and compacting operations in general, as can be seen from a cursory review of published patent documents. Some specific, non-exhaustive, examples of United States Patents that disclose rolling compactor machines include: U.S. Pat. No. 3,302,540 ("Fuentes"), U.S. Pat. No. 3,947,142 ("Takata et al."), U.S. Pat. No. 4,471,850 ("Rotz"), U.S. Pat. No. 4,662,779 and U.S. Pat. No. 3,403,610 ("Kaltenegger"), U.S. Pat. No. 4,699,543 ("Mio et al."), U.S. Pat. No. 4,861,189 ("Fukukawa et al."), U.S. Pat. No. 4,878,544 ("Barnhart"), U.S. Pat. No. 4,964,753 ("Ciminelli et al."), U.S. Pat. No. 5,046,891 ("Vural"), U.S. Pat. No. 5,082,396 ("Polacek"). All of these patents are hereby incorporated by reference.

Rotz teaches a drum-type asphalt compactor having a pair of drum-compactor units. An important feature of Rotz's invention is the articulated nature of the two drums. As with the present invention, the two drums are joined together with a joint means and the two sections do not share a common frame. Polacek also discloses this type of roller. Polacek's invention is a vibratory roller having a frame comprised of pivotally interconnected front and rear subframes.

Kaltenegger discloses a road roller that includes a pair of rotatable roller drums each having axially opposite end portions. A key feature of the Kaltenegger machine is the ability of the two drums to pivot relative to one another. Similar to Kaltenegger, the Takata et al. patent teaches a tandem drum-type pavement compacting machine having front and rear drums with the ability of pivoting or being "offset". However, unlike Kaltenegger, Takata et al. further discloses the ability of finishing surfaces not lying in a flat plane because the front drum can oscillate or pivot relative to the chassis and the rear drum.

A different approach to compacting is taken by Barnhart. The Barnhart patent discloses a compactor that is not self-propelled and is designed as an attachment to an earth moving equipment. While Barnhart is similar to the present invention in using an attachment, Barnhart's invention is rear mounted and still suffers from the limitation of requiring a driver to drive on the shoulder area in order to compact it.

A number of other patents have specifically addressed the difficulty of working in sloped or inclined environments. Fukukawa et al. discloses a method for paving inclined and/or curved surfaces using a vehicle which is connected by wires to an anchor vehicle. Mio et al. also discloses a paving machine which uses a boom extending from a truck. Lastly, Fuentes teaches a method and apparatus for compacting, rolling, and finishing the earth especially on sloped surfaces. Fuentes' apparatus comprises a truck with a compacting apparatus with a single rolling drum. While these inventions all address the problem of working in a sloped environment their solutions are not completely satisfactory. In particular, they would not be efficiently usable for rolling the shoulder area of a roadway in a single pass while the vehicle drives on the roadway. Additionally, these designs are probably too heavy to operate on a newly paved roadway as they would destroy the surface. Thus, for practicality and cost effectiveness, these options are not workable solutions for compacting shoulder areas.

Despite the many existing designs, there continues to be a need for improved designs for roadway compacting machinery, especially for compacting on sloped surfaces such as a roadway shoulder. In particular, there is a need to address the safety of compacting the shoulder areas of roadways by not having an operator drive a compacter in a tilted manner or in a backward direction. Both of these can be tipping hazards. The present invention addresses these needs. Accordingly, the following are stated objections of the present invention.

It is an object of the present invention to reduce or eliminate the tipping dangers associated with rolling roadway shoulders with a driver operated road roller.

It is another object of the invention to provide a compaction roller that can roll a sloped surface (e.g. a road shoulder) while the operator remains safe on a relatively level surface (e.g. the road).

It is an object of the present invention to provide a compaction roller attachment that can be side-mounted to a self driven piece of machinery.

It is an additional object of the present invention to provide a compaction roller capable of pinching the edge of the road and simultaneously rolling the shoulder area in one forward operation.

It is also an object of the invention to provide a compaction roller having two roller drums that can simultaneously compact two surfaces each lying on a different plane.

With these objectives in mind, the manner in which the invention achieves its purpose will be appreciated from the following description and the accompanying drawings, which exemplify the invention, it being understood that changes may be made in the specific apparatus disclosed herein without departing from the essentials of the invention set forth in the appended claims.

SUMMARY OF THE INVENTION

The invention is a compaction roller particularly useful for vibration compaction of the shoulder area of roadways and other surfaces requiring reqiiifed compacting. The compactor is designed as an attachment for side-mounting to self-propelled or motorized machinery (e.g. a skid steer front loader). The compaction roller contains: (a) a rear section comprising a frame connected to a rear cylindrical roller, (b) a front section comprising a frame connected to a front cylindrical roller; (c) a joining means pivotally connecting said rear and front sections; and (d) a means for attaching to self-propelled machinery in a side mounted fashion.

DETAILED DESCRIPTION OF THE INVENTION

Figure 1:
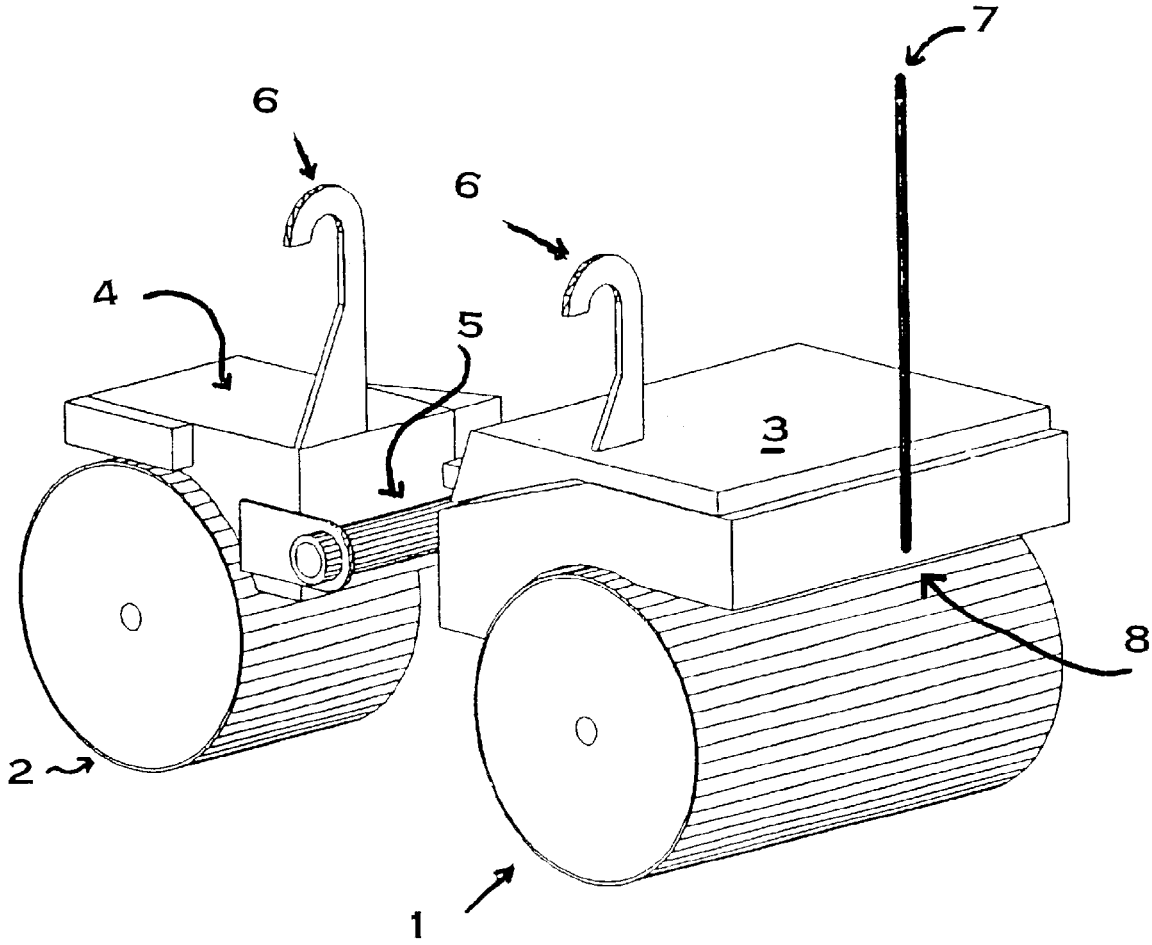
FIG. 1 is an isometric view of a preferred embodiment of the invention.

As shown in the accompanying Figures, the compaction roller of the present invention has a rear section comprising a frame unit 3 supporting a rear cylindrical drum 1 on its axis ends (not shown). The rear section is connected to a front section also having a frame unit 4 supporting a front cylindrical drum 2 via its axis ends (not shown). The front section and the rear section are connected via a pivot joining means 12 allowing the rear section to pivot or rotate about an axis that is approximately parallel to the direction of travel. The compactor has a connection means 5 for fixedly attaching the front section to self propelled machinery. The rear section may also contain a stabilizer bar 7 connected to the rear section via a swivel joint 8. The stabilizer provides enhanced stability to the rear section by providing a second attachment point to the self-propelled machinery that the roller is side-mounted to. The compactor may also contain a transport means 6. The transport means in the Figures are hooks that allow the shoulder roller to be conveniently lifted, moved, transported, or stored using any piece of machinery or other device capable of fitting underneath the hooks in order to move or hold the compactor. Many other designs for the transport means allowing the compactor to be lifted could be used but hooks have been found to be particularly convenient to the present inventors.

The rollers or drums 1 and 2 used in the present invention are not strictly limited and can be essentially any rollers capable of compacting the type of materials used in roadway and roadway shoulder construction (e.g. asphalt, gravel, etc.). The rollers can be vibratory or non-vibratory and many such rollers are commercially available as will be known to one skilled in the art. Preferably at least the rear roller is a vibratory roller. The size of the drum can also vary widely depending on the application. Commercially available drums useful as the rear drum in the present invention typically have a width in the range of 24 to 48 inches. Drums useful as the front drum in the invention will generally be smaller than the rear drum and can range preferably from 12 to 36 inches. The prototype made by the inventors has a 36 inch rear drum and an 18 inch front drum. In a preferred embodiment, the front drum is a non-vibratory drum and is about half the size of the rear drum which is vibratory. The inventors have found that this embodiment allows a lot of versatility in performing compacting operations of various types.

The frames of the front 4 and rear 3 sections are illustrated in the Figures as having a particular shape. However, the specific design of the frames can vary significantly in the broader scope of the invention. The frames of the present invention must serve three basic purposes. First they must support the rollers. Many frame designs are known for this purpose, most or all have a means for supporting the axis ends of the drums. In a typical embodiment (not shown in the Figures), both front and rear frame assemblies will contain support brackets (often disc or semi-circular shaped) proximate to the drum ends having a receiving means containing bearings for receiving the axis of the drum assemblies. The second requirement of the frame assemblies is that they must provide for a joining means 12 between the two sections. Third, they must allow for side-mounting to a vehicle or other machinery as discussed in further detail below. Optionally, the frames can provide for any supporting devices or mechanisms. Many such devices are possible; some examples include hydraulics, vibration equipment, scrapers, deflectors, ballasts, park brakes, water systems etc. Within these parameters, the specific design of the frame can take on many shapes as will be apparent to those familiar with compaction machinery and other construction equipment.

Figure 2:
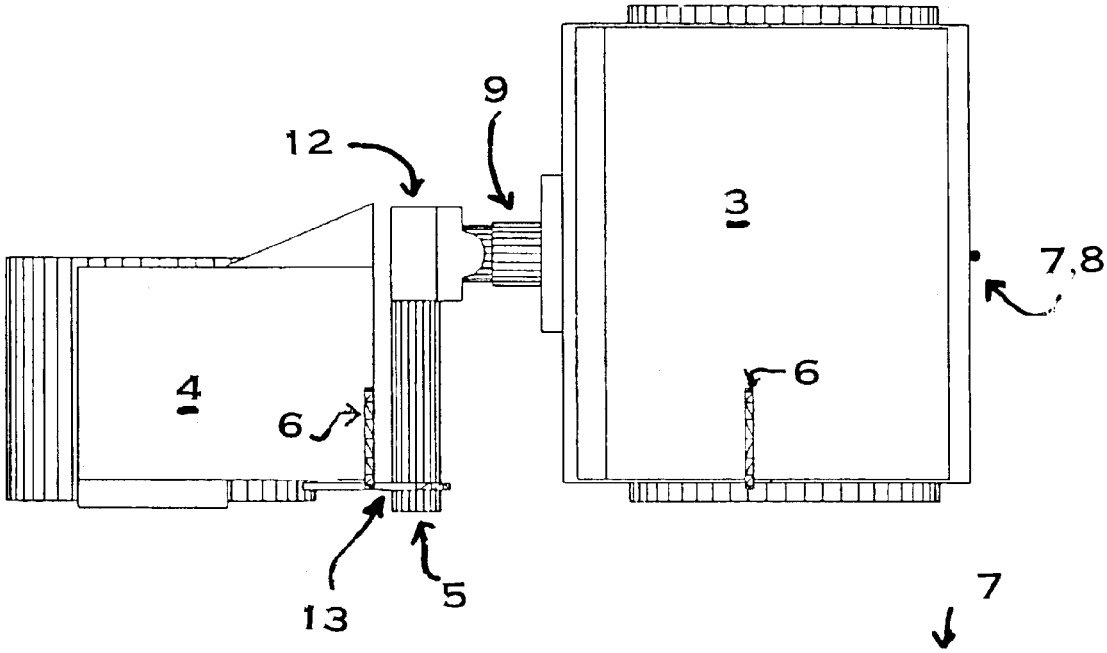
FIG. 2 is a top view of the shoulder roller shown in FIG. 1.
Figure 3:
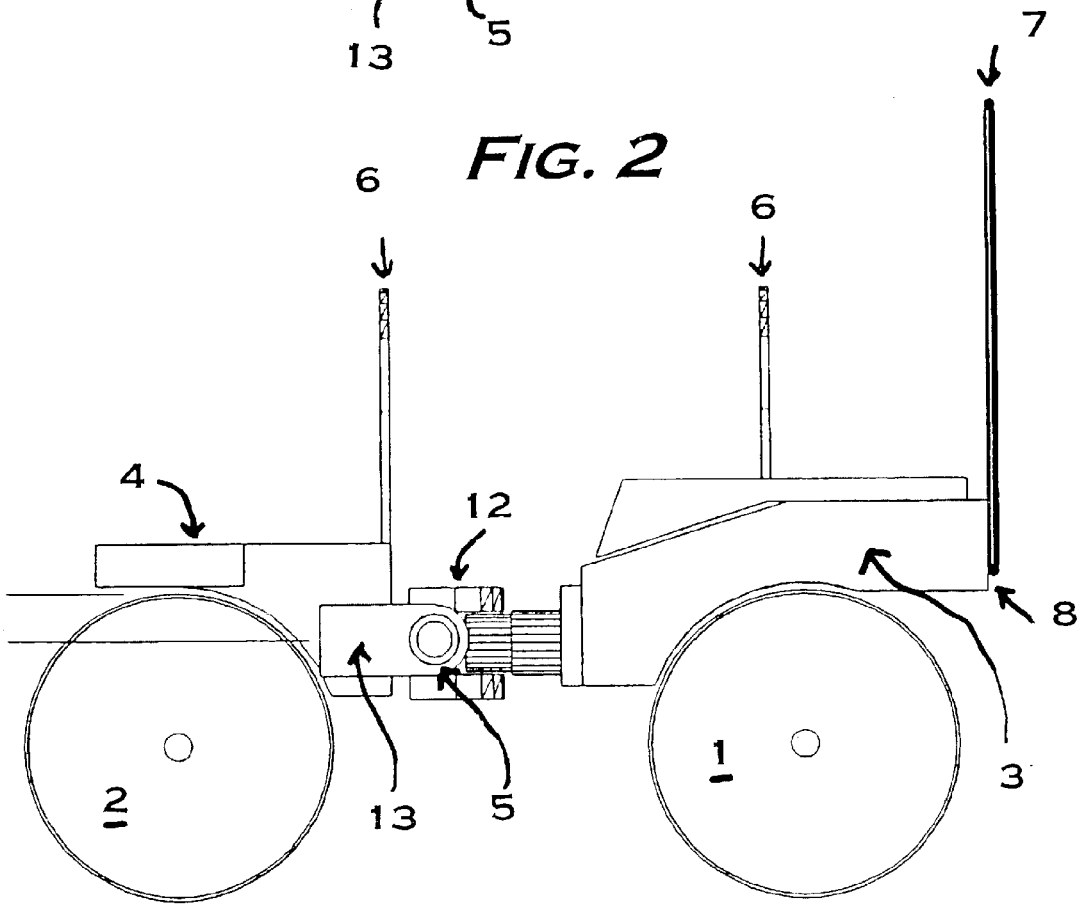
FIG. 3 is a side view of the shoulder roller shown in FIG. 2.

The front and rear sections are connected via a pivot joining means 12 shown particularly in FIGS. 2 and 3. The rear section extends a connector 9 from the rear frame 3 into the pivot/axle joint 12. The connector shaft 9 has an axis which is generally parallel to the direction of travel of the roller (i.e. the axis is parallel to a line that is perpendicular to the axis of the rear drum 1). In a preferred embodiment of the invention, the joining means 12 and the rear frame connector 9 are designed such that the rear frame and drum can rotate about the axis of the connector shaft 9. Theoretically, this rotation could be up to about 90 degrees in either direction (clockwise or counterclockwise) relative to the front frame 4 and drum 2 which will be generally kept level with the roadway surface. However, practically speaking compacting sloped shoulders approaching or much beyond 45 degrees from the roadway surface is not very practical. Optionally, stops can be provided on the joint to limit the amount of rotation if desired. In a simple embodiment of the connection joint 12, the joint is made by a shaft 9 passing through a cylindrical female receptacle 12 containing an internal circumferential ring of bearings or bushings (not shown) allowing rotation about the shaft 9 axis. The shaft is held in the female receptacle capping the end (e.g. with a nut) of the shaft 9. This is not shown in the Figures.

Figure 4:
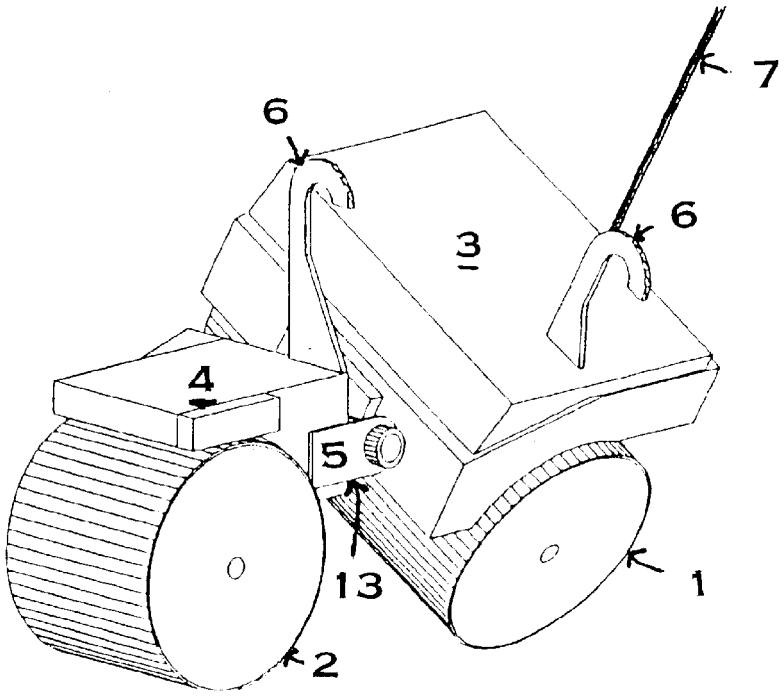
FIG. 4 is an isometric view of the shoulder roller shown in FIG. 1 and additionally illustrating the pivoting nature of the rear drum.
Figure 5:
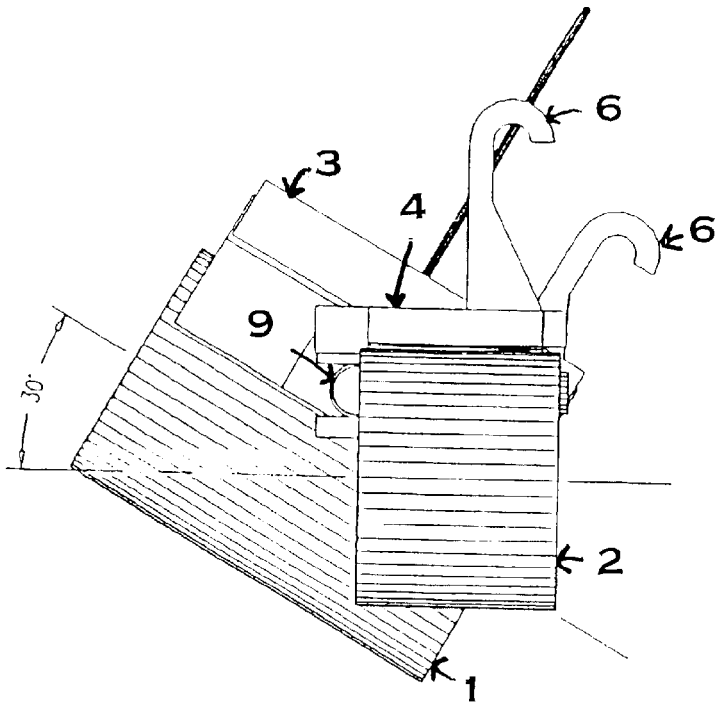
FIG. 5 is a front view of the shoulder roller shown in FIG. 4.

The female receptacle of the joining means 12 is also fixedly connected to the front frame so that the shaft 9 and rear section rotate relative to the front section. In the embodiment shown in the Figures, the joining means 12 is connected to the shaft 5 that receives the attachment means (10 & 11). and the joint 12 and shaft 5 are together fixedly connected to the front frame assembly via a mounting bracket 13. In a preferred embodiment, the joint 12 and connector shaft 5 are connected to the front frame almost entirely along their length for maximum support and durability. It will be obvious to those skilled in the art that different types of connections to the front frame can be made and the female receptacle can even be part of the front frame. The critical feature is that the rear frame must be able to rotate about an axis that is approximately parallel to the direction of travel. Other joint designs that allow this rotation are within the scope of the invention. Finally, note that FIGS. 4 and 5 show the rear assembly rotated in a clockwise manner relative to the front assembly when viewed from the front. However, the rear drum could just as easily be rotated in the counter-clockwise direction. The direction and amount of rotation will be highly dependent on the specification operation being performed.

The pivot joint mechanism described above is the simple method used to create the pivot joint 12 of the prototype of the invention. However, other designs allowing the rear section to rotate about an axis parallel to the direction of travel are possible and are included as part of the present invention. The rotation allowed by the pivot joint 12 is illustrated in FIGS. 4 and 5. This feature is an important part of the present invention as it allows the roller to compact two different surfaces at the same time, each surface on their own plane and thus having different slopes. This is the feature that makes the present invention especially applicable as a shoulder roller. The roadway and its shoulder often lie on two different planes with the roadway level or near level and the shoulder gradually sloped down and away from the roadway. The shoulder roller of the present invention can pinch the edge of a roadway with the front drum and simultaneously compact the shoulder with the rear drum. Prior to the present invention this required two or more passes with a compactor and was less safe because the operator of the compactor had to drive on the sloped shoulder. With the present invention, the driver remains on a leveler and safer roadway, free from a tipping hazard.

Since the roller compactor of the invention is an attachment, there must also be a means for attaching the compactor to a propelled piece of machinery. In the prototype of the invention as represented by the Figures, this attachment means is a shaft 5 that is connected to both the female receptacle of the pivot joint 12 and the rear portion of the front frame 4. This shaft is generally parallel to the axis of the front drum and the rear drum (when on a level surface and not rotated). The shaft 5 is generally perpendicular to shaft 9 and does not rotate as does shaft 9. Thus, shaft 5 is fixed relative to the front sections and while FIGS. 2 and 3 show that the shaft 5 is connected in two discrete locations, the shaft preferably is connected all along its length and may even be incorporated into the front frame itself.

Figure 6:
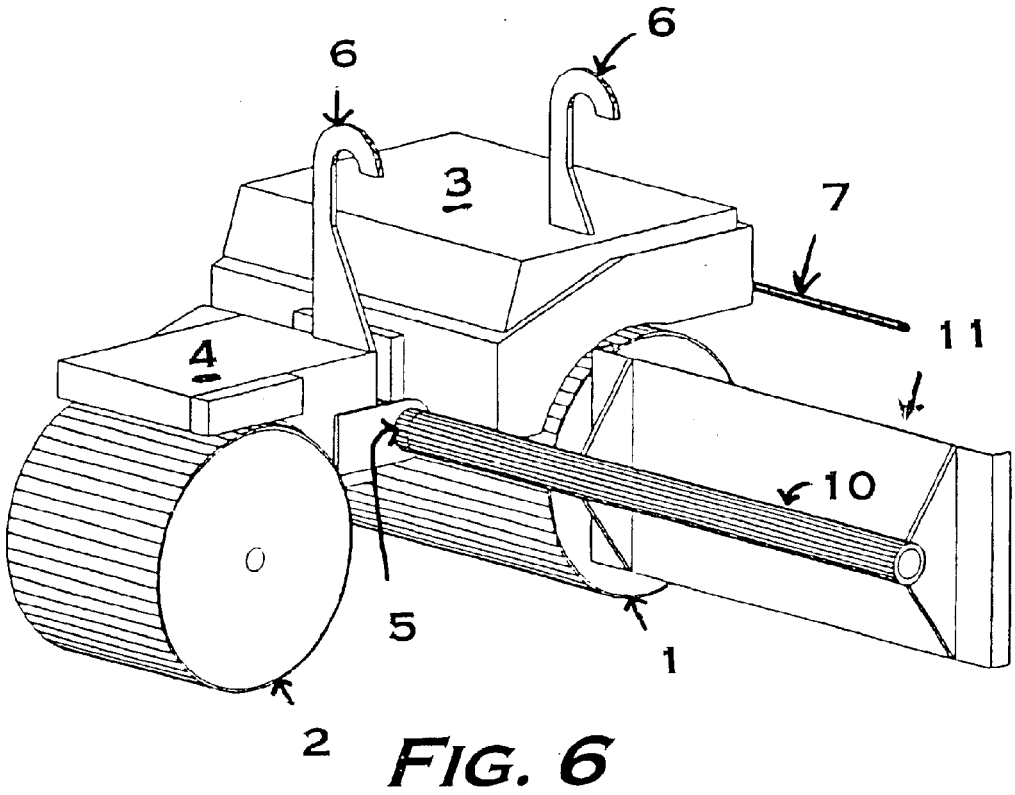
FIG. 6 is an isometric view additionally showing an attachment means for attaching the shoulder roller to driven machinery (e.g. a skid steer).
Figure 7:
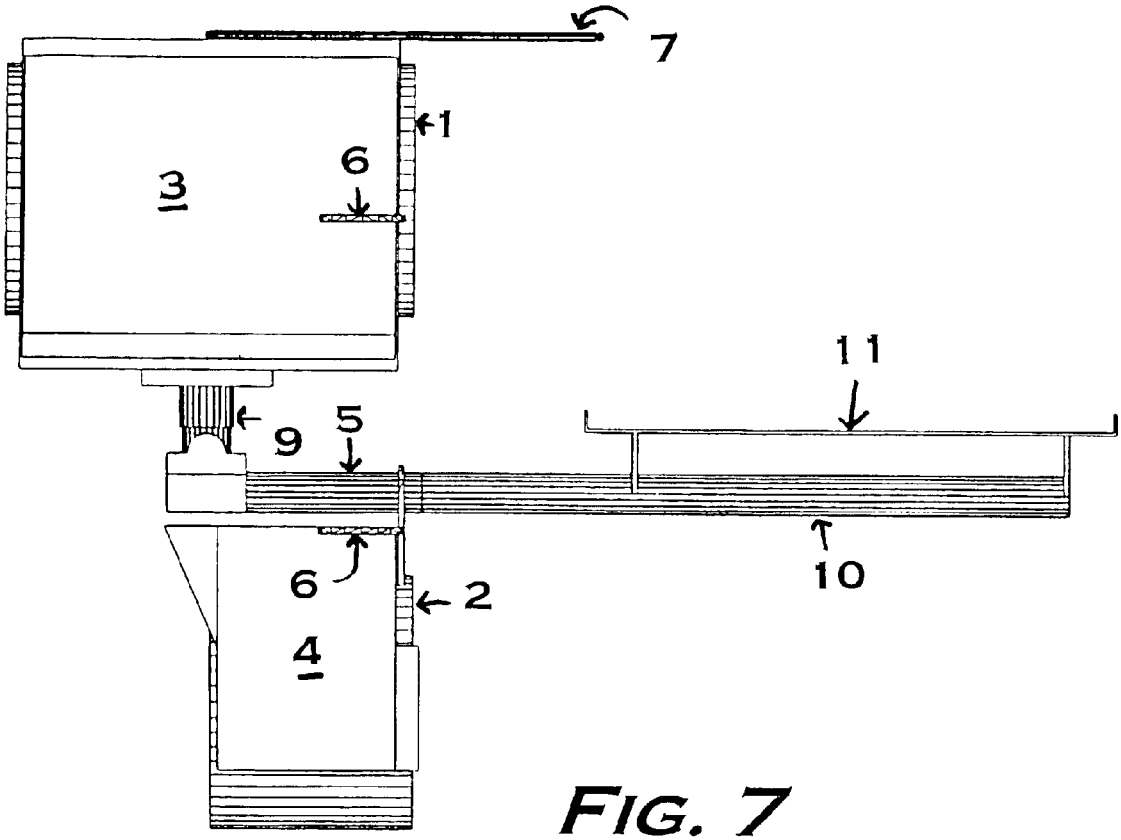
FIG. 7 is a top view of the shoulder roller with attachment means shown in FIG. 6.

The primary feature of this attachment means is that it is capable of rigidly attaching the front section of the compactor to propelled machinery in a side mounted fashion. Many designs are possible to make this connection. In the embodiment represented by the Figures, the connector shaft 5 receives the attachment arm 10 which is connected to the mounting plate 11. The attachment arm slides in the attachment shaft 5 and is held securely by a drop pin put through aligned holes (not shown) in the end of the attachment arm and the end of the shaft 5 near joint 12. The mounting plate 11 can be attached to self propelled machinery (not shown) in a known fashion common in construction machinery attachments. The particular means of attaching the mounting plate 11 to the self-propelled machinery is not a critical part of the invention and will depend highly upon the type of machinery used to drive the compactor. In fact, the mounting means may not even be a plate at all as other methods are common. The mounting plate 11 shown in FIGS. 6 and 7 was used by the present inventors to attach the compactor to the front of a Case Skid Steer. The compactor was also attached to the side of the skid steer with stabilizer 7 for added stability to the rear section. The stabilizer is connected to the skid steer via a bolt and mounting plate. The stabilizer is especially useful in environments where the slope of the shoulder is more severe. However, in non-severe slope environments, it may not be needed.

Those familiar with earth handling and other vehicles will immediately recognize that other attachment options are possible depending upon the type of vehicle being used and other factors. An important feature of the attachment is that it allows the compactor to operate on the road shoulder while the operator is driving the propelled machinery on the roadway. This is the intended meaning of the term "side-mount" used in the present application. Even though the mounting plate 11 is attached to the front of the skid steer in our example the actual compactor is positioned generally to the side of the skid steer via the attachment arm 10.

The self-propelled machinery used to drive the compactor of the invention can be any piece of machinery that can be driven and can be attached to the compactor. In addition to the preferred skid steers, this machinery includes backhoes, industrial and farm tractors, graders, pickup trucks, wheel loaders, dump trucks, and bull dozers (including rubber-track bull dozers). The inventors have found that front loaders (e.g. skid steers) are particularly convenient for attaching the shoulder roller. Skid steers are available through a number of manufacturers including John Deere, Case, and Caterpillar.

Finally, while not illustrated in the drawings, an additional connection from the self-propelled vehicle to the side-mounted shoulder roller is typically present. These connections are hydraulic lines and/or other lines that run the vibration means on the roller. These connections are optional as it is possible for the roller to have a self-contained vibration means or no vibration mechanism at all.

An additional embodiment of the invention adds a hydraulic pressure cylinder connected to the rear frame and to the front frame or a similar device fixedly connected to the front frame. This adds the capability of forcing the rear drum to maintain a specific pivot angle relative to the front section. Thus, the pivot degree can be hydraulically determined and not freely determined by the surface being compacted.

While the invention has been particularly shown and described with reference to preferred embodiments thereof, it will be understood by those skilled in the art that various alterations in form and detail may be made therein without departing from the spirit and scope of the invention. In particular, the invention is not limited to the specific narrow embodiment set forth in the attached drawings as the specific design of the frames, drums, joining means, and attachment means can vary significantly within the parameters set forth in this application.

What we claim is:

1. A compaction roller attachment for side-mounting to self-propelled machinery, said compaction roller attachment comprising:

a) a front section comprising a frame connected to a front cylindrical roller;

b) a rear section comprising a frame connected to a rear cylindrical roller;

c) a joining means pivotally connecting said front and rear sections;

d) a laterally extending attachment means for attaching the compaction roller in parallel relation to self propelled machinery;

wherein said front roller has a width that is smaller than the width of the rear roller; and wherein said rollers each have outer left and right ends and wherein the front roller is positioned in an offset manner such that either the outer left or right ends of the rollers lie in the same plane when the compaction roller is on a level surface.

2. The compaction roller according to claim 1, wherein one or both of the rollers are vibratory rollers.

3. The compaction roller according to claim 1 wherein only the rear roller is a vibratory roller.

4. The compaction roller according to claim 1, wherein the width of the front roller is about half the width of the rear roller.

5. The compaction roller according to claim 1, additionally comprising transport means on said front and rear sections.

6. The compaction roller according to claim 1, wherein the joining means allows the rear section to freely rotate about an axis that is generally parallel to the direction of travel.

7. The compaction roller according to claim 1, wherein the laterally extending attachment means is rigidly fixed to the front frame and is capable of connecting to a self-propelled or motorized vehicle.

8. The compaction roller according to claim 1, additionally comprising a rear stabilizer bar that connects the rear frame to the self-propelled machinery.

9. The compaction roller according to claim 1, additionally comprising a means for hydraulically determining the degree of rotation of the rear section.

* * * * *